US008172331B2

(12) United States Patent
Cramer et al.

(10) Patent No.: US 8,172,331 B2
(45) Date of Patent: May 8, 2012

(54) BARIATRIC SEATING FURNITURE

(75) Inventors: E. Daniel Cramer, Minneapolis, MN (US); Paul A. James, Edina, MN (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 12/476,732

(22) Filed: Jun. 2, 2009

(65) Prior Publication Data

US 2009/0295214 A1 Dec. 3, 2009

Related U.S. Application Data

(60) Provisional application No. 61/058,435, filed on Jun. 3, 2008.

(51) Int. Cl.
*A47C 1/12* (2006.01)
*A47C 7/02* (2006.01)

(52) U.S. Cl. ..... 297/446.2; 297/452.33; 297/449.1

(58) Field of Classification Search ..... 297/446.2, 297/452.33, 445.1, 449.1, 446.1, 451.1, 450.1, 297/452.29, 452.21; D6/377, 334, 374
See application file for complete search history.

(56) References Cited

U.S. PATENT DOCUMENTS 1,772,979 A 8/1930 Bell
D173,392 S * 11/1954 Sherman ..... D6/334
2,764,228 A * 9/1956 Donohue ..... 297/446.2
D182,591 S * 4/1958 Hirtle ..... D6/374
2,936,826 A 5/1960 Reiniman
D336,165 S * 6/1993 Tihany ..... D6/334
D385,712 S * 11/1997 Rottet ..... D6/379
5,690,388 A * 11/1997 Saiger ..... 297/447.2
D406,198 S * 3/1999 Lin et al. ..... D6/379

FOREIGN PATENT DOCUMENTS

GB 889300 2/1962

OTHER PUBLICATIONS

Toy Tractor Museum and W.L. (Lee) Bunfill Estate Auction, Jul. 28, 2007, McCollough Auction Service, Inc. (accessed on Jul. 14, 2009), URL: http://www.mccolloughauctions.com/toymuseumauction/pg46.php.
International Search Report dated Jul. 29, 2009.

* cited by examiner

*Primary Examiner* — Milton Nelson, Jr.
(74) *Attorney, Agent, or Firm* — Andrus, Sceales, Starke & Sawall, LLP

(57) ABSTRACT

An article of seating furniture that is particularly desirable for use with bariatric patients is disclosed. The seating furniture includes a seat portion that includes a front seating area and a rear seating area. The front seating area is defined by a generally semi-elliptical front perimeter surface while the rear seating area is defined by a different, generally semi-elliptical rear perimeter surface. The surface area of the front seating area is less than the surface area of the rear seating area to provide enhanced ingress and egress for a bariatric patient. The seating furniture includes a back portion and two pair of support legs that further enhance the desirability of the seating furniture for a bariatric patient.

11 Claims, 9 Drawing Sheets

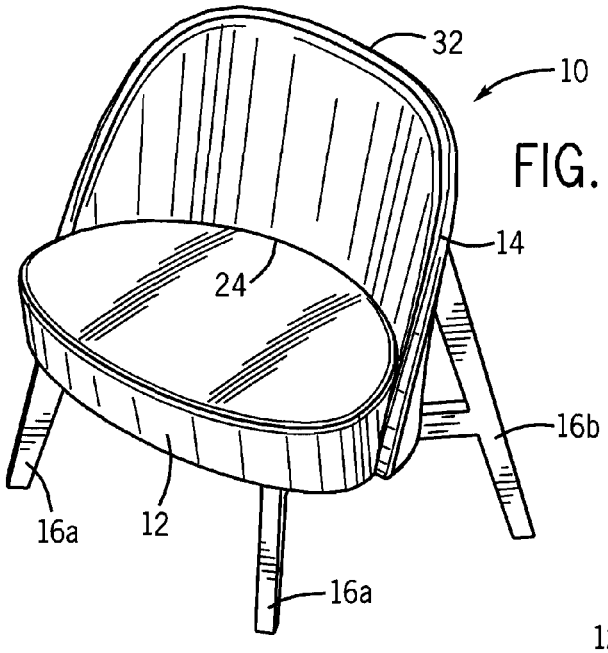
FIG. 1A
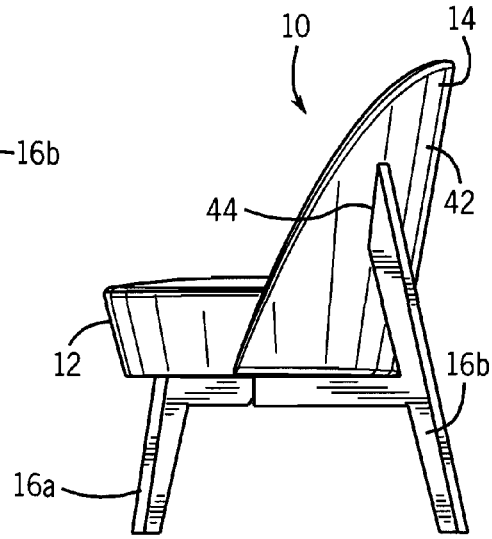
FIG. 1B
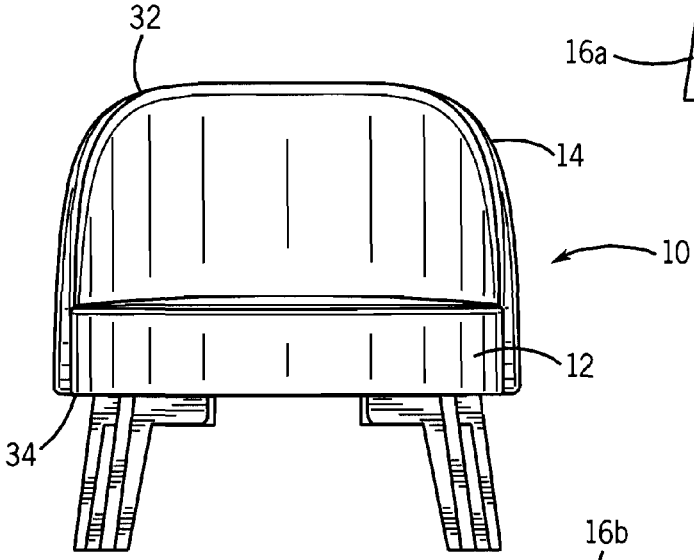
FIG. 1C
FIG. 1D
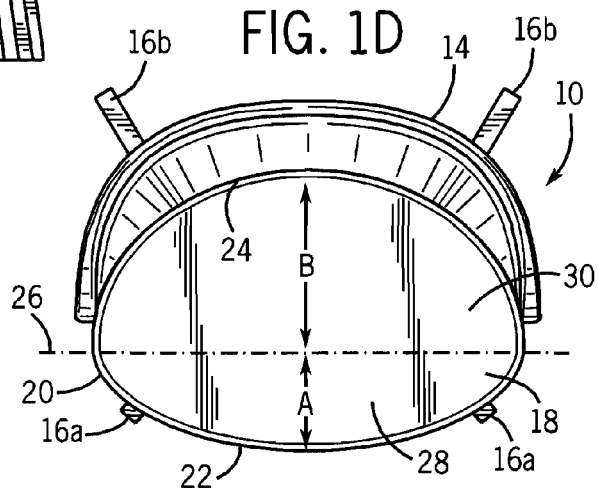

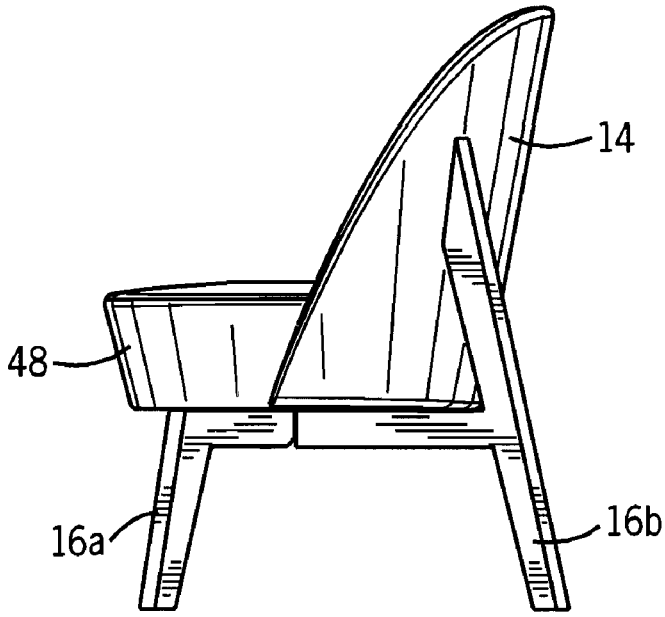
FIG. 4C
FIG. 4D
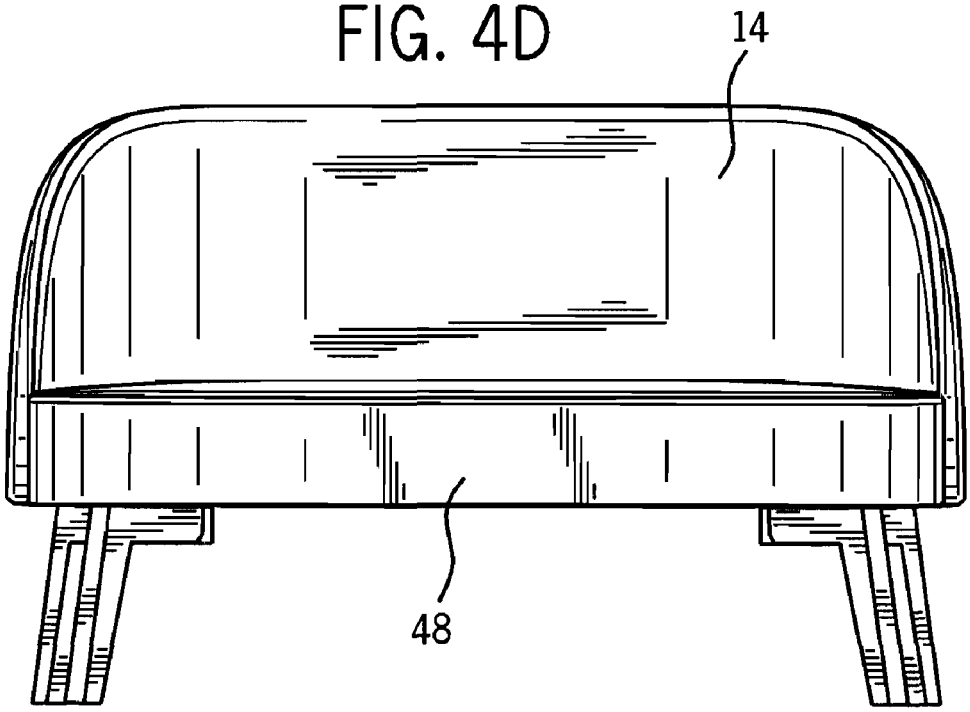

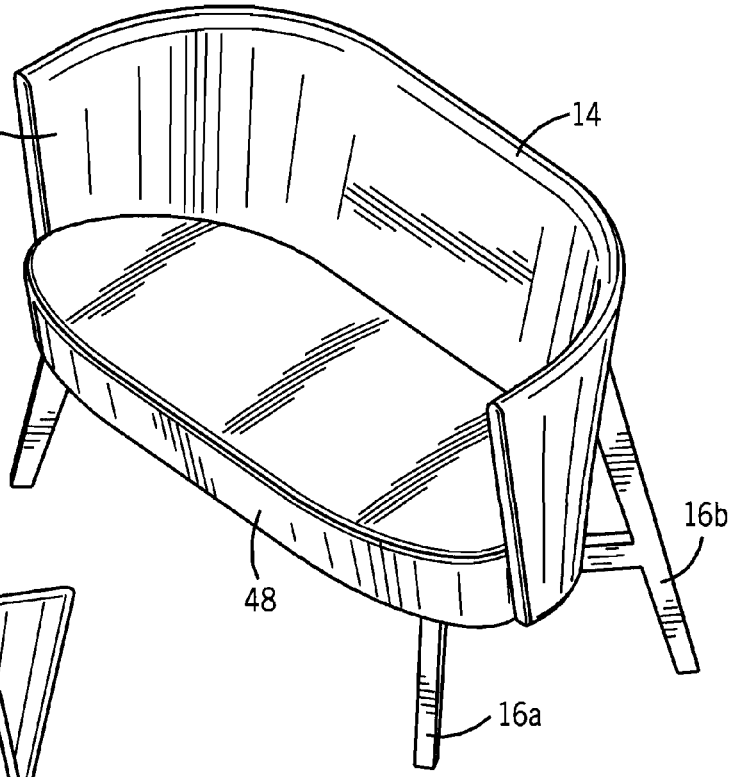
FIG. 5A
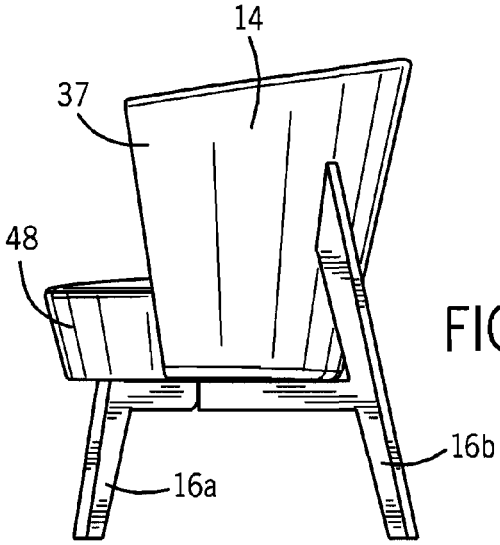
FIG. 5B
FIG. 5C
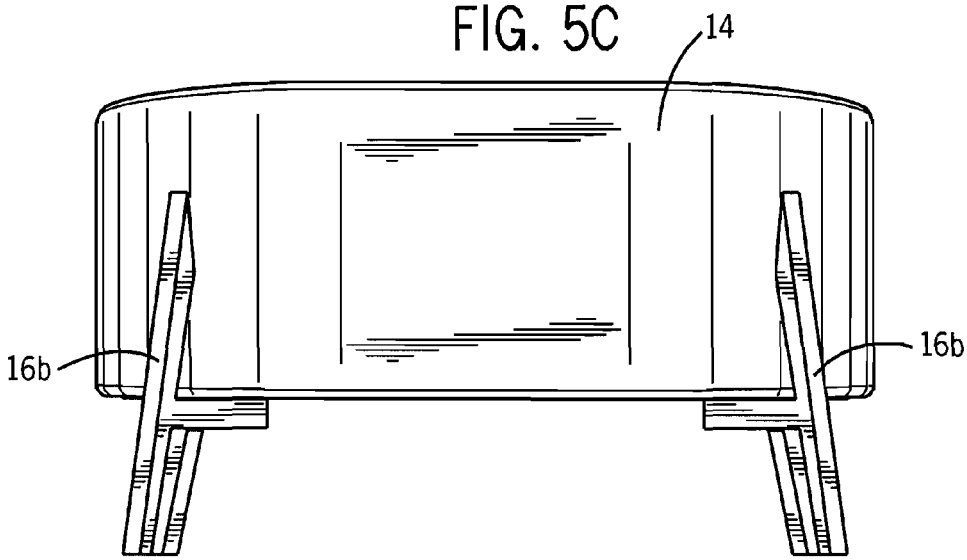

BARIATRIC SEATING FURNITURE

CROSS-REFERENCE TO RELATED APPLICATION

The present application is based on and claims priority to U.S. Provisional Patent Application Ser. No. 61/058,435, filed on Jun. 3, 2008.

BACKGROUND

The trend toward obesity has impacted health care industries more than some others, since health care providers attempt to treat obesity as well as treating patients dealing with the side effects of obesity, including vascular difficulties, diabetes, and so forth.

Health care providers and vendors to the health care industry have been required to develop products that will suit the unique needs of this population, including wheelchairs, toilets, and hospital beds that support additional size and weight. Furniture for waiting rooms and patient examination rooms are also needed.

The Business and Institutional Furniture Manufacturing Association (BIFMA) promulgates preferred standards for such furniture. Typically, attempts to provide furniture for this population of patients focus simply on function: appropriate seating for bariatric patients must be sturdy enough to hold a patient's weight, large enough to accommodate his or her girth, allow the patient relatively simple ingress and egress, and not be susceptible to tipping during ingress and egress. It is notable that when an obese person sits in the traditional orientation in a standard sized chair, with hips parallel to the chair back, poor posture is often observed due to the seat's inability to properly accommodate the person's body size.

Many providers have been able to meet the functional needs of bariatric patients, but even when in accordance with BIFMA standards, meeting these functional needs has essentially consisted of creating a stretched and reinforced version of regular seating. This furniture has the awkward appearance of being for an obese person such that the patient is required to use a "special" chair. This approach is in conflict with health care providers' ultimate goal of treating all patients with respect and dignity, and presents bariatric patients with additional barriers and stigma in the common areas and examination/treatment rooms of health care facilities. In addition, the stretched and reinforced versions typically fail to comfortably seat the remainder of the patient population, so that the health care provider who seeks to make both obese and non-obese patients comfortable, including most hospitals, doctor's offices, therapy providers and the like, are obliged to have both bariatric and non-bariatric seating available.

Current bariatric seating solutions also fail to appreciate the fact that obese people frequently are unable to rest their arms directly against their bodies due to a combination of arm and body girth. In addition, obese people often sit higher in chairs due to additional tissue covering the rear end and thighs. Further, chairs that have openings at the side and/or back fail to provide a sense of visual privacy, and again such furniture falls short of health care providers' desire to provide an environment that allows all patients to be as physically and emotionally comfortable as possible.

FIGS. 7-8 illustrate the ways that research has shown obese people, such as a bariatric patient 2, typically sit down in standard armless chairs 4, such as are often found in waiting rooms and elsewhere. Specifically, obese people tend to approach entry to a seat 6 from the side, i.e., with hips oriented perpendicular to the chair back 8. It is believed that the side approach enables a better fit onto the seat and, perhaps more importantly, provides for easier entry into the seat. Frequently, this approach is accompanied by use of an arm on the chair back (not shown) to support the person's weight.

Egress from a chair is equally important. Obese people tend to advance toward the front of the chair and use the armrests to aid in egress. However, currently available bariatric furniture provides a seating depth that is approximately equal from side to side and front to back. It does not make accommodations for a bariatric patient's need to shift a large body weight, usually heavily balanced toward the rear of the person, forward and out of a seated position.

A need exists for a seating solution that will address the seating needs of all sizes of people, including obese people, and will thus provide a health care facility with a single seating solution for its common areas. A seating solution that includes armrests that are wider and taller than in standard seating furniture, and preferably that provides an enclosed space around the sides and back of the furniture is also desirable. In addition, the angle of approach and departure from a seating solution is significant. A need exists for a seating solution that provides a shallow angle of ingress and egress such that it is easily approached from the side and allows a bariatric patient to readily shift his or her weight forward into a standing position.

SUMMARY OF THE INVENTION

The present disclosure generally relates to seating furniture particularly useful by a bariatric patient. More specifically, the present disclosure relates to seating furniture that includes a seat portion having a relatively shallow depth front seating area and a deeper rear seating area.

The seat portion of the seating furniture generally includes an outer perimeter. The outer perimeter includes a front perimeter edge and a rear perimeter edge that are joined to each other along a seating axis. The combination of the front perimeter edge and the seating axis define a front seating area while the combination of the seating axis and the rear perimeter edge define a rear seating area.

The seat portion is configured such that the maximum depth of the front seating area is less than the maximum depth of the rear seating area to enhance the ease of ingress and egress for a bariatric patient. Preferably, both the front perimeter edge and the rear perimeter edge are generally semi-elliptical.

The seating furniture includes a back portion that extends along the rear perimeter edge defining the rear seating area. Configuration of the back portion aids in supporting a patient during the ingress and egress from the seating furniture.

The seating furniture further includes at least two pair of legs for supporting the seating furniture on a horizontal support surface. Preferably, both the front legs and the rear legs extend outwardly past the outer perimeter that defines the seat portion to provide enhanced stability for the seating furniture. In one embodiment, the rear legs of the seating furniture are joined the back portion at a location above the seat portion to provide enhanced support for the back portion.

BRIEF DESCRIPTION OF THE DRAWINGS

Preferred exemplary embodiments of the invention are illustrated in the accompanying drawings, in which like reference numerals represent like parts throughout, and in which:

FIGS. 1A-1D illustrate a first embodiment of the furniture of the present disclosure, in the form of an armless chair;

FIGS. 4A-4D illustrate a fourth embodiment of the furniture of the present disclosure, in the form of an armless loveseat;

FIGS. 5A-5C illustrate a fifth embodiment of the furniture of the present disclosure, in the form of a loveseat with arms;

DETAILED DESCRIPTION OF THE INVENTION

Figure 9:
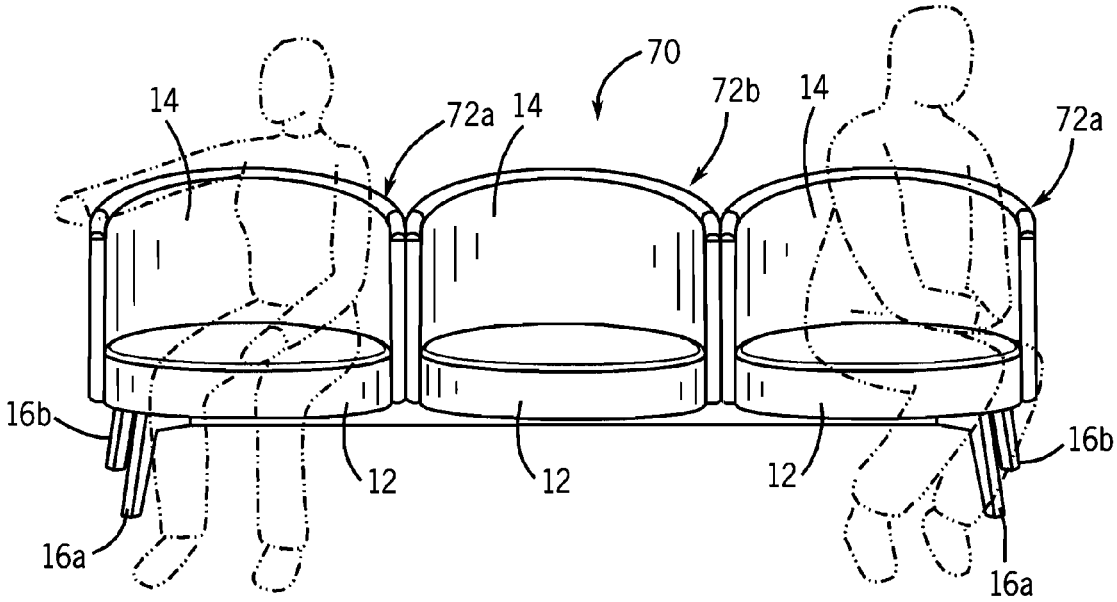
FIG. 9 is a front view of a bank embodiment of the seating of the present disclosure illustrating both a non-bariatric patient and a bariatric patient seated.
Figure 10:
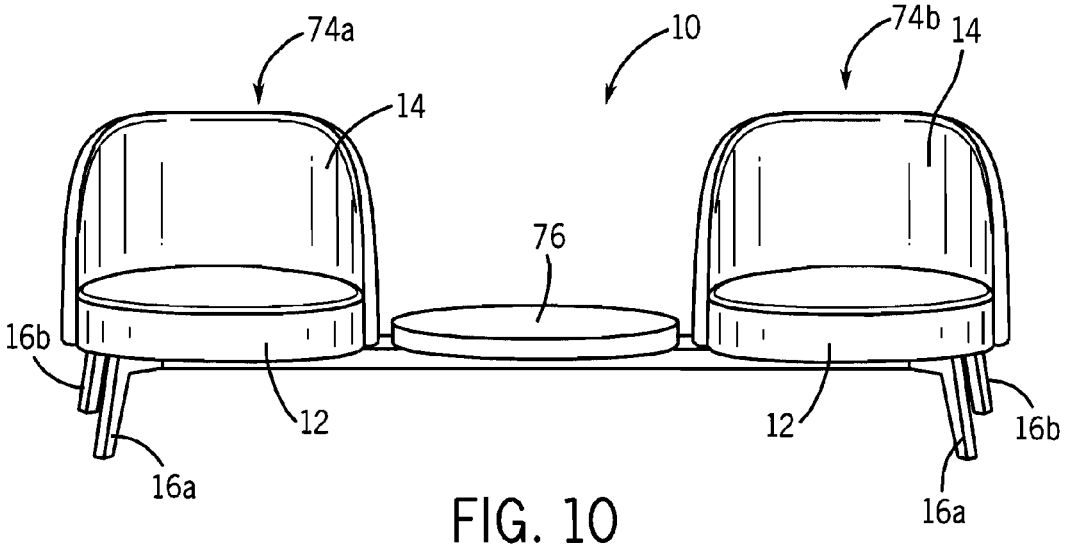
FIG. 10 is a front perspective view of an armless seat-and-table bank embodiment of the present disclosure.

In each of FIGS. 1-6 and 9-10, an article of seating furniture is shown. Although some of seating furniture is designed as stand-alone seating, as shown in FIGS. 1-6, many embodiments are envisioned. For example, a loveseat embodiment, such as is shown in FIGS. 4-5, a multiple seating bank embodiment shown in FIG. 9, and a multiple seating/table bank embodiment shown in FIG. 10, are all within the scope of the disclosure. However, for the sake of convenience, the terms "furniture" or "seating furniture" may be interchanged with the term "chair" or "chairs" without limiting the scope of the disclosure, which is set forth in the appended claims.

Referring first to FIGS. 1A-1D, there shown is a first embodiment of the seating furniture 10 constructed in accordance with the present disclosure. In the embodiment shown in FIGS. 1A-1D, the seating furniture has the form of a chair designed to support a single occupant. The seating furniture 10 generally includes a seat portion 12, a back portion 14 and four legs. The legs include a pair of front legs 16*a* and a pair of rear legs 16*b* that are designed to support the seat portion 12 above a generally horizontal support surface, such as the floor.

Referring to FIG. 1D, the seat portion 12 includes a top support surface 18 that is generally defined by an outer perimeter 20. In accordance with the present disclosure, the outer perimeter 20 includes a front perimeter edge 22 and a rear perimeter edge 24. In the embodiment illustrated, both the front perimeter edge 22 and the rear perimeter edge 24 have the general shape of a semi-ellipse. In the embodiment illustrated, the front perimeter edge 22 and the rear perimeter edge each have a different semi-elliptical shape. As illustrated, the front perimeter edge 22 has a shallower shape as compared to the deeper shape of the rear perimeter edge 24. The front and rear perimeter edges 22, 24 are joined to each other along a seating axis 26.

The front perimeter edge 22 and the seating axis 26 combine to define a front seating area 28 while the seating axis 26 and the rear perimeter edge 28 combine to define a rear seating area 30. Since the shape of the front perimeter edge 22 and the rear perimeter edge 24 are different from each other, the surface area of the front seating area 28 is different from the surface area of the rear seating area 30, as can be clearly illustrated in FIG. 1D.

In the embodiment illustrated in FIG. 1D, the depth of the front seating area 28 is determined by the distance from the seating axis 26 to the front perimeter edge 22. Reference character A illustrates the maximum depth of the front seating area 28. Likewise, the depth of the rear seating area 30 is determined by the distance from the seating axis 26 to the rear perimeter edge 24. Reference character B illustrates the maximum depth of the rear seating area 30.

In accordance with the design of the seating furniture 10 shown in FIGS. 1A-1D, the maximum depth A of the front seating area 28 is substantially less than the maximum depth B of the rear seating area 30. In this regard, the surface area of the front seating area 28 is substantially less than the surface area of the rear seating area 30.

In the alternate embodiments shown in FIGS. 2A-2C and 3A-3B, the seat portion 12 has the identical configuration to the seat portion shown in the first embodiment of FIGS. 1A-1D. However, the embodiments shown in FIGS. 2A-2C and 3A-3B have modified configurations of the back portion 14 as will be described in the following portions of the present disclosure.

Referring back to FIG. 1D, the front seating area 28 has a relatively shallow elliptical outline while the rear seating area 30 has a much deeper and more rounded elliptical outline. The relatively shallow front seating area 28 allows a person to enter the chair with his or her hips and legs oriented in an angle to the front seating area 28 or to enter the chair at an angle parallel to the front seating area 28. In this manner, the configuration of the seat portion 12 allows both bariatric patients and normal sized patients to utilize the seating furniture 10 shown in the embodiment of FIGS. 1A-1D.

As an example, sitting in the center of the seating furniture 10 with hips oriented directly parallel to the seating axis 26 provides the greatest seat depth. Sitting just to the left or right of the center of the seating portion 12 reduces the seat depth while sitting even further from the center line further reduces the seat depth. The shape of the seat portion 12, specifically the relatively shallow elliptical shape of the front seating area 28 and the relatively deep elliptical shape of the rear seating area 30 allows a person of almost any size to be comfortably accommodated by simply shifting his or her body to either side of center. Notably, such adjustability is made easier for bariatric patients by allowing an angled approach to the seating furniture 10.

Referring now to FIG. 1C, the back portion 14 of the seating furniture 10 is defined by a top edge surface 32. The top edge surface 32 defines the most vertical portion of the seating furniture and, in the embodiment shown in FIG. 1C, extends from the bottom edge 34 of the seat portion 12. As can be seen in FIG. 1A, the back portion is positioned adjacent to the rear perimeter edge 24 and extends vertically above the seat portion 12 to the top edge 32. In the embodiment illustrated in FIGS. 1A-1D, the back portion 14 is solid over the entirety of the back portion 14 and does not include any openings. The solid back portion 14 conceals the back of the seat occupant when the occupant is seated on the furniture 10, which is often important to image conscious bariatric patients.

Referring now to FIG. 1D, the back portion 14 extends only along the rear perimeter edge 24 and does not reach the seating axis 26. Thus, the entire front seating area 28 is positioned in front of the back portion 14. This configuration of the back portion 14 allows for easier ingress and egress for a bariatric patient.

Figure 2A:
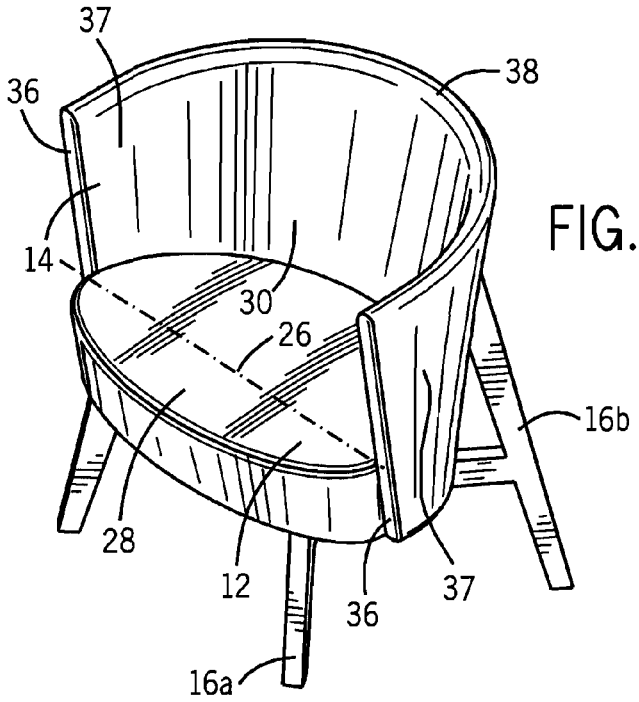
FIGS. 2A-2C illustrate a second embodiment of the furniture of the present disclosure, in the form of an armchair.
Figure 2B:
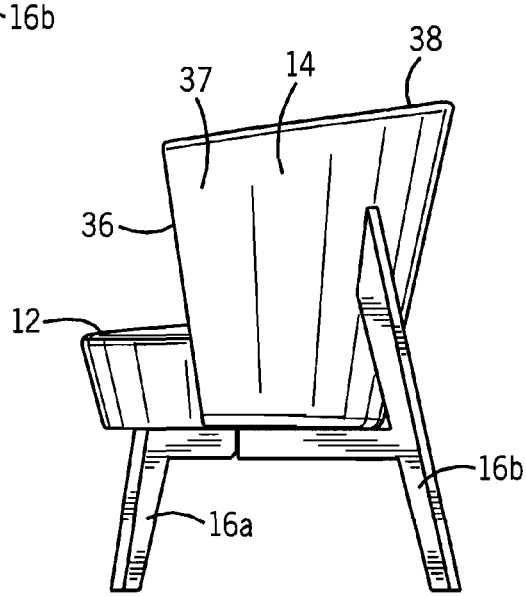
Figure 2C:
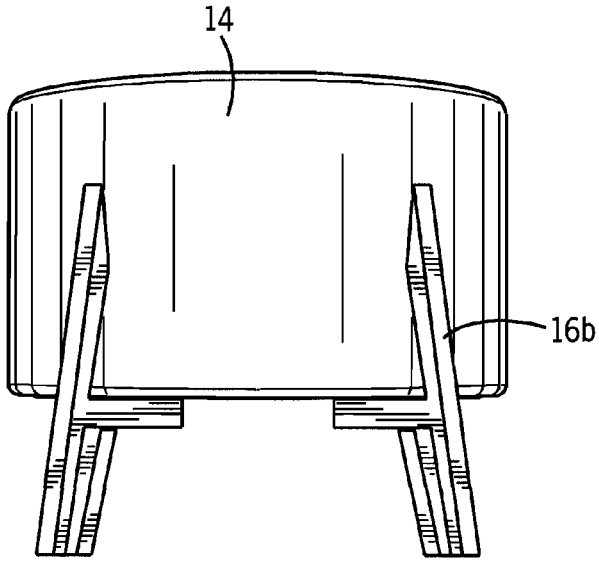

Referring now to the embodiment shown in FIGS. 2A-2C, the back portion 14 is shown having a much different configuration. In the embodiment of FIGS. 2A-2C, the back portion 14 is defined by a pair of front edges 36 that each extend from the top edge surface 38. As can be easily understood in a comparison of FIGS. 1A-1D to FIGS. 2A-2C, the back portion 14 in FIGS. 2A-2C defines arms 37 for the seating furniture 10. In the embodiment of FIGS. 2A-2C, the front edges 36 extend to the seating axis 26 that separates the front seating area 28 and the rear seating area 30.

Figure 3A:
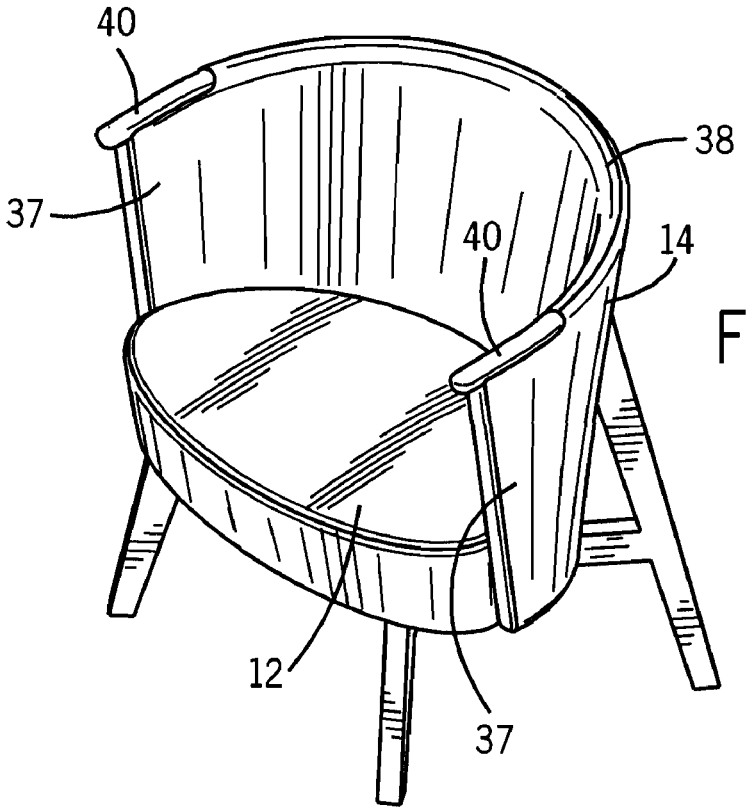
FIGS. 3A-3B illustrate a third embodiment of the furniture of the present disclosure, in the form of an armchair with caps extending from the arms.
Figure 3B:
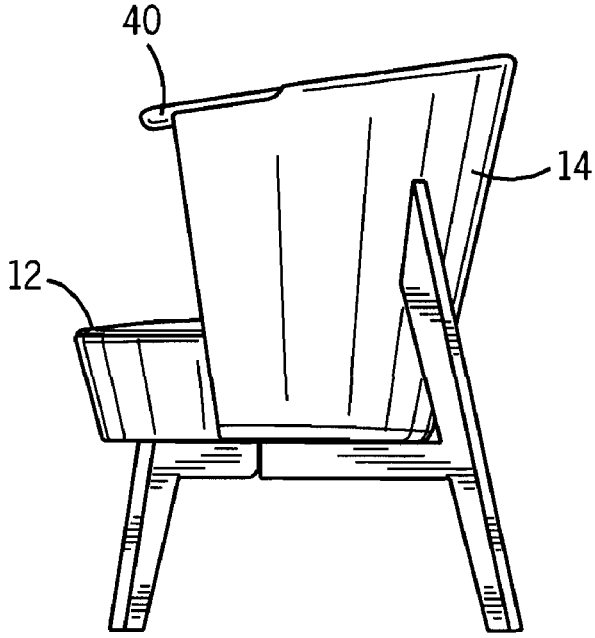

In the embodiment shown in FIGS. 3A-3B, the top edge 38 of the back portion 14 includes arm end caps 40 formed on the arms 37. The arm end caps 40 provide a place for an occupant to grip the back portion 14 during both egress and ingress into the seating furniture 10.

Referring back to FIGS. 1A-1D, in addition to the specific design of the seat portion 12 to accommodate bariatric patients, the seating furniture 10 also includes specifically designed legs 16 to accommodate the increased weight of patients who may lean on the seating furniture 10 for support while both entering or exiting the seating furniture. As can be seen in FIG. 1B, both the front legs 16*a* and the rear legs 16*b* are angled relative to vertical to provide greater support for the seating surface 12. In the embodiment shown in FIG. 1B, the front legs 16*a* and the rear legs 16*b* are angled relative to vertical at at least 10 degrees and, preferably, approximately 15degrees. When viewed from above, as shown in FIG. 1 D, both the rear legs 16*b* and the front legs 16*a* extend outwardly past the outer perimeter 20 of the seat portion 12. Further, the rear legs 16*b* extend past the back portion 14 to provide enhanced stability for the seating furniture 10.

Referring back to FIG. 1B, each of the rear legs 16*b* extends above the seat portion 12 and contacts the outer surface 42 of the back portion 14 at a location 44 positioned vertically above the seat portion 12. The connection between the rear legs 16*b* and the back portion 14 provides additional support for the back portion 14. The additional support for the back portion 14 is specifically desirable when a heavy bariatric patient is leaning against the back portion 14. The embodiments shown in FIGS. 2A-2C and 3A-3B also include similar front and rear legs 16*a*, 16*b* to the embodiment shown in FIGS. 1A-1D.

Figure 4A:
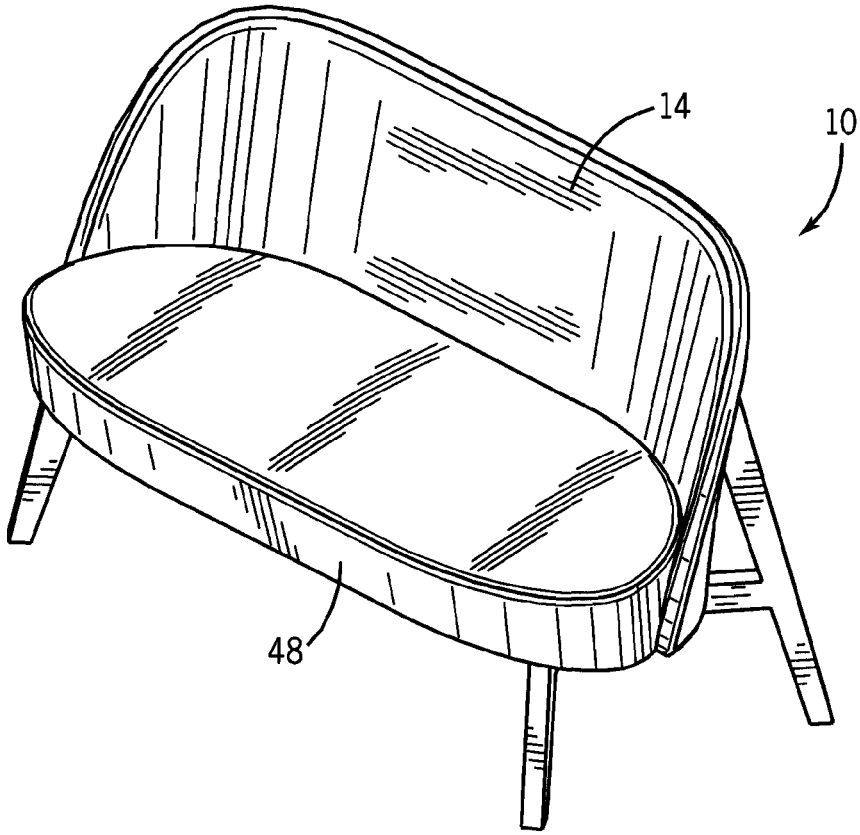
Figure 4B:
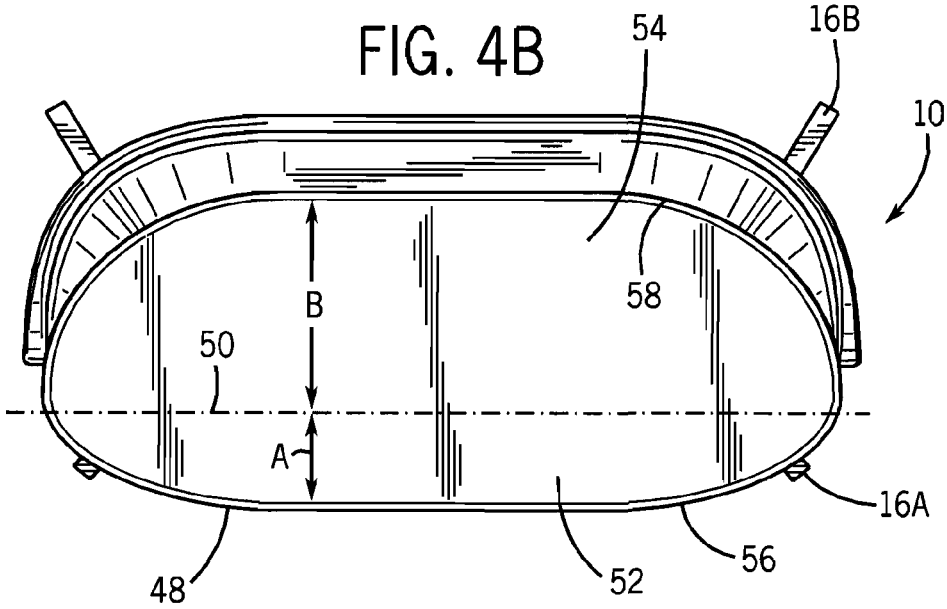

Referring now to FIGS. 4A-4D, there shown is yet another embodiment of the seating furniture 10. In the embodiment of FIGS. 4A-4D, the seating furniture takes the shape of a love seat having a seat portion 48 that can accommodate two individuals. As illustrated in FIG. 4B, the love seat includes a similar seat axis 50 that separates a front seating area 52 from a rear seating area 54. As with the embodiment shown in FIGS. 1A-1D, the depth of the front seating area 52 is substantially less than the depth of the rear seating area 54, as illustrated by similar reference characters A and B. The front seating area 52 is defined by the front perimeter edge 56 while the rear seating area 54 is defined by the rear perimeter edge 58. Once again, the front perimeter edge 56 and the rear perimeter edge 58 have a generally semi-elliptical shape as in the embodiment shown in FIGS. 1A-1D. However, in the embodiment of FIGS. 4A-4D, the generally semi-elliptical shape is elongated to accommodate the generally wider seat portion 48 of the love seat.

In the embodiment of FIGS. 4A-4B, the front legs 16*a* and the rear legs 16*b* again extend outwardly from the seat portion 48 to provide enhanced support for the seating furniture 10.

The back portion 14 of the love seat shown in FIGS. 4A-4D generally corresponds to the back portion shown for the seat of FIGS. 1A-1D.

FIGS. 5A-5C illustrates another embodiment of the love seat version of the seating furniture. In the embodiment of FIG. 5A-5C, the back portion 14 generally corresponds to the back portion of the chair shown in FIGS. 2A-2C.

Figure 6A:
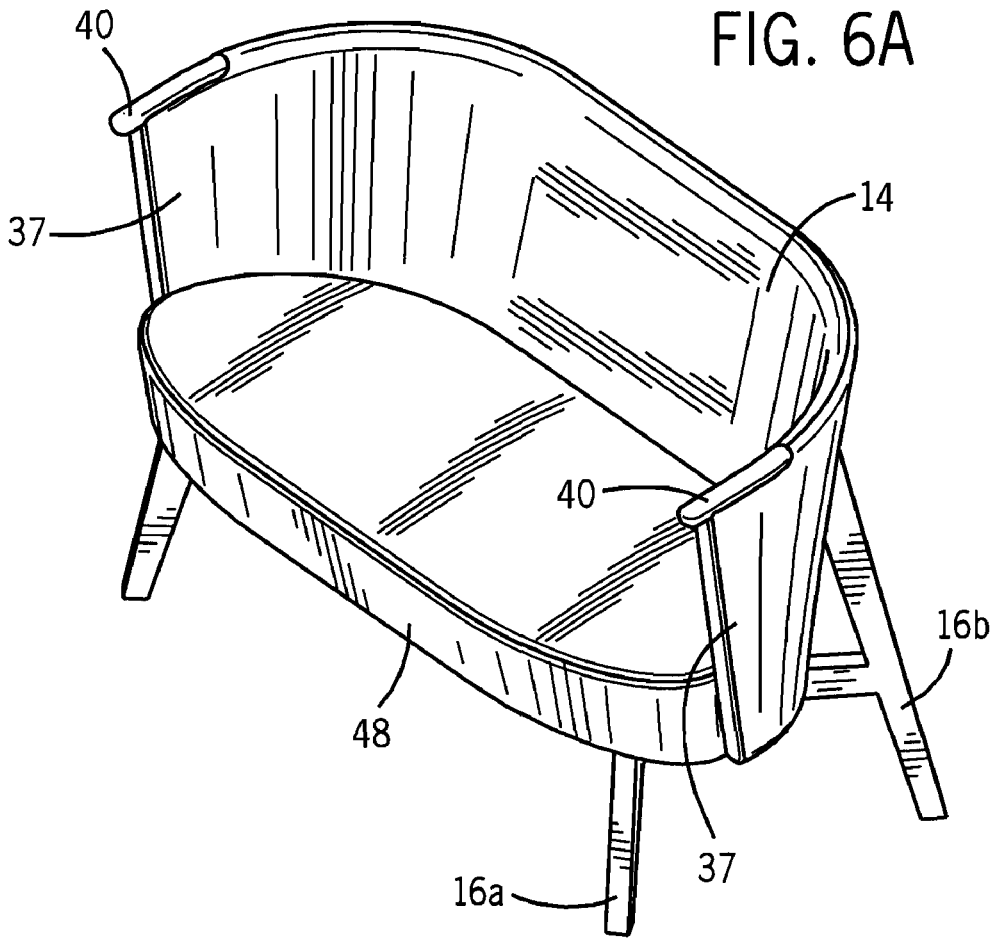
FIGS. 6A-6B illustrate a sixth embodiment of the furniture of the present disclosure, in the form of a loveseat with arms and caps extending from the arms.
Figure 6B:
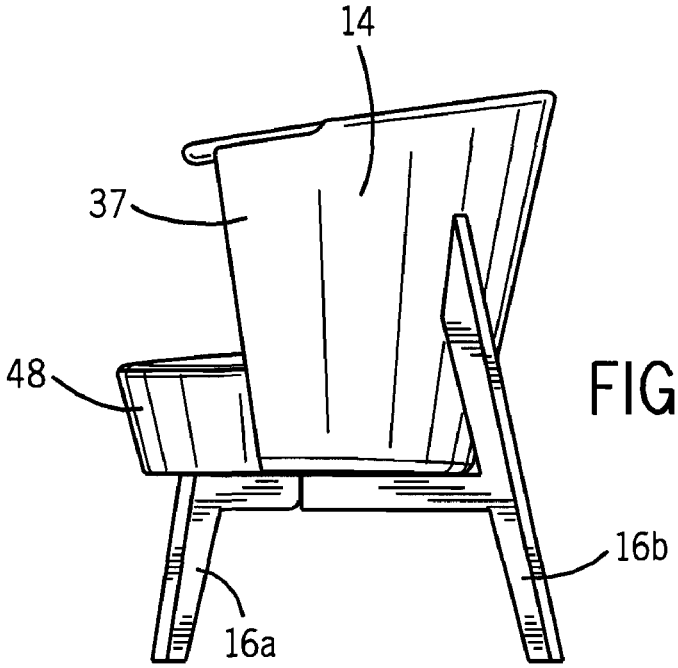
Figure 7:
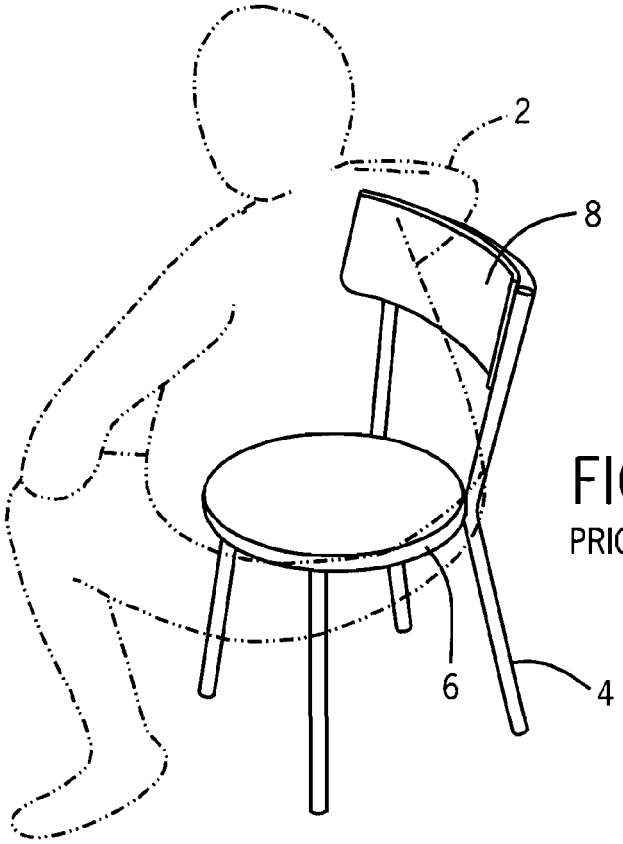
FIG. 7 PRIOR ART
FIG. 7 is a perspective view of a bariatric patient seated on the side in a standard chair, showing the patient's full body in shadow.
Figure 8:
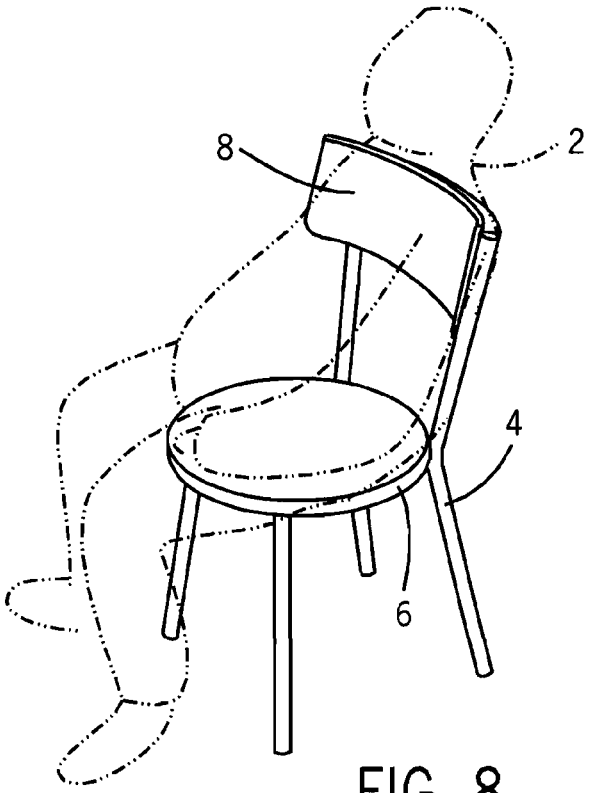
FIG. 8 PRIOR ART
FIG. 8 is perspective view of a bariatric patient seated in a front-facing position in a standard chair, showing the patient's full body in shadow.

FIGS. 6A-6B illustrates yet another embodiment of the love seat design that includes the end caps 40 formed on the arms 37 of the back portion 14.

Referring now to FIG. 9, there shown is a multi-seat embodiment 70 of the seating furniture. In the multi-seat embodiment, three separate seating areas 72*a*, 72*b* and 72*c* are supported by a single pair of front legs 16*a* and rear legs 16*b*. Each of the seating areas 72*a*-72*c* includes a seat portion 12 and a back portion 14. The seat portion 12 and back portion 14 are constructed similar to the seat portion 12 and back portion 14 shown in the embodiment of FIGS. 4A-4D.

Referring now to FIG. 10, there shown is yet another alternate embodiment of the seating furniture 10. In the embodiment shown in FIG. 10, the seating furniture 10 includes a pair of seating elements 74*a* and 74*b* along with a table surface 76. Each of these seating elements 74*a*, 74*b* includes a seat portion 12 and a back portion 14 constructed in accordance with the embodiment shown in FIGS. 1A-1D. The seating furniture of FIG. 10 includes a pair of front legs 16*a* and rear legs 16*b* that are also each connected in accordance with the embodiment of FIGS. 1A-1D.

In use, an armrest embodiment of the present invention creates a relationship between arms and front area that aids a bariatric patient in moving from a fully forward, center seated position in chair 10 to an exit position by placing his or her fullest weight on arms that lie forward of the person's center of mass. This creates better arm leverage for the person and also better overall body leverage by allowing the person's legs to be positioned under (rather than forward of) the center of gravity of his or her body.

The embodiments described herein explain the best known mode of practicing the invention and will enable others skilled in the art to utilize the invention, but should not be considered limiting. Rather, it should be understood that the invention is not limited to the details of construction and arrangements of the components set forth herein, but additional embodiments are possible and may be constructed in various ways, and all such modifications and variations are within the scope of the claims set forth below. Further, various elements or features discussed or shown herein may be combined in ways other than those specifically mentioned, and all such combinations are likewise within the scope of the invention.

We claim:

1. An article of seating furniture comprising:

a seat portion having a seating area defined by an outer perimeter having a front perimeter edge and a rear perimeter edge, wherein the front perimeter edge and the rear perimeter edge each have a generally elliptical shape distinct from each other, wherein the front perimeter edge defines a front seating area and the rear perimeter edge defines a rear seating area, wherein the front seating area and the rear seating area are joined along a seating axis;

a back portion positioned adjacent to the seat portion and extending above the seating area when the article of seating furniture is supported on a horizontal support surface; and a plurality of legs extending below the seat portion to support the seating furniture on the horizontal support surface, wherein at least a pair of the legs extend away from an outer surface of the back portion at an angle of at least 10° relative to vertical and are joined to both the seat portion and the outer surface of the back portion above the seat portion to support the back portion and the seat portion, wherein a depth of the front seating area is defined from the seating axis to the front perimeter edge and a depth of the rear seating area is defined from the seating axis to the rear perimeter edge, wherein a maximum depth of the front seating area is less than a maximum depth of the rear seating area.

2. The article of claim 1 wherein the back portion extends above the seat portion and is defined by a top edge, wherein the back portion is solid without any openings from the seat portion to the top edge.

3. The article of claim 2 wherein the back portion is positioned vertically adjacent to the seat portion and extends along only the rear perimeter edge that defines the rear seating area such that the front perimeter edge is freely accessible along its entirety.

4. The article of claim 1 wherein the front seating area has a generally rounded semi-elliptical shape and the rear seating area has a generally rounded semi-elliptical shape.

5. The article of claim 4 wherein the area of the front seating area is less than the area of the rear seating area.

6. An article of seating furniture comprising:

a seat portion having a seating area defined by an outer perimeter having a semi-elliptical front perimeter edge and a semi-elliptical rear perimeter edge joined to each other along a seating axis, wherein the front perimeter edge and the seating axis define a front seating area and the rear perimeter edge and the seating axis define a rear seating area, wherein a depth of the front seating area is defined from the seating axis to the front perimeter edge and a depth of the rear seatin area is defined from the seating axis to the rear perimeter edge, wherein a maximum depth of the front seating area is less than a maximum depth of the rear seating area such that the surface area of the front seating area is less than the surface area of the rear seating area;

a back portion positioned vertically adjacent to the seat portion and extending from the rear seating area to a top edge surface above the rear seating area when the article of seating furniture is supported on a horizontal support surface, the back portion having a solid outer surface, wherein the back portion extends only along the rear perimeter edge such that the front perimeter edge is freely accessible along its entirety; and a plurality of legs extending below the seat portion to support the seating furniture on the horizontal support surface, wherein at least a pair of the legs are joined to the outer surface of the back portion above the seat portion and below the top edge surface to support both the back portion and the seat portion, wherein the pair of legs extend outwardly relative to vertical and are oriented to engage the horizontal support surface outwardly of the seating area.

7. The article of claim 6 wherein the back portion is solid from the seat portion to the top edge surface without any openings.

8. The article of claim 6 wherein two pair of legs extend outwardly of the seat portion.

9. An article of seating furniture comprising:

a seat portion having a seating area defined by an outer perimeter having a semi-elliptical front perimeter edge and a semi-elliptical rear perimeter edge, wherein the semi-elliptical shape of the front perimeter edge and the rear perimeter edge are different from each other;

a back portion positioned adjacent to the seat portion and extending above the seating area when the article of seating furniture is supported on a horizontal support surface, the back portion extending along only the rear perimeter edge and having a solid outer surface; and a plurality of legs extending below the seat portion to support the seating furniture along a horizontal support surface, wherein at least a pair of the legs are joined to both the seat portion and the outer surface of the back portion above the seat portion to support both the back portion and the seat portion, wherein the pair of legs extend outwardly away from the outer surface at an angle of at least 10° relative to vertical and are oriented to engage the horizontal support surface outwardly of the seating area.

10. The article of claim 9 wherein the pair of legs engages the horizontal support surface outwardly of the back portion.

11. The article of claim 9 wherein two pair of legs extend outwardly of the seat portion.

* * * * *

UNITED STATES PATENT AND TRADEMARK OFFICE

CERTIFICATE OF CORRECTION

PATENT NO. : 8,172,331 B2
APPLICATION NO. : 12/476732
DATED : May 8, 2012
INVENTOR(S) : E. Daniel Cramer and Paul A. James It is certified that error appears in the above-identified patent and that said Letters Patent is hereby corrected as shown below:

In claim 6, col. 7, line 36, delete "seatin" and substitute therefor --seating--.

Signed and Sealed this
Thirty-first Day of July, 2012

David J. Kappos

David J. Kappos
*Director of the United States Patent and Trademark Office*